US008187508B2

(12) United States Patent
Kanoh et al.

(10) Patent No.: US 8,187,508 B2
(45) Date of Patent: May 29, 2012

(54) BASE AGENT FOR ELECTRICAL INSULATING OIL

(75) Inventors: Takaaki Kanoh, Tokyo (JP); Jun-ichi Yamada, Tokyo (JP); Hidenobu Koide, Tokyo (JP); Yasunori Hatta, Tokyo (JP)

(73) Assignees: Lion Corporation, Tokyo (JP); Japan AE Power Systems Corporation, Tokyo (JP)

( * ) Notice: Subject to any disclaimer, the term of this patent is extended or adjusted under 35 U.S.C. 154(b) by 448 days.

(21) Appl. No.: 12/066,045

(22) PCT Filed: Sep. 6, 2006

(86) PCT No.: PCT/JP2006/317620

§ 371 (c)(1),
(2), (4) Date: Mar. 6, 2008

(87) PCT Pub. No.: WO2007/029724

PCT Pub. Date: Mar. 15, 2007

(65) Prior Publication Data

US 2009/0270644 A1 Oct. 29, 2009

(30) Foreign Application Priority Data

Sep. 9, 2005 (JP) ..... 2005-262280

(51) Int. Cl.
*H01B 3/20* (2006.01)
*C10M 150/38* (2006.01)

(52) U.S. Cl. ..... 252/579; 252/68; 252/570; 508/485; 507/138; 336/58

(58) Field of Classification Search ..... None
See application file for complete search history.

(56) References Cited

U.S. PATENT DOCUMENTS

| | | | | |
|---|---|---|---|---|
| 5,949,017 | A | 9/1999 | Oommen et al. | |
| 5,958,851 | A * | 9/1999 | Cannon et al. | 508/491 |
| 6,184,459 | B1 | 2/2001 | McShane et al. | |
| 6,312,623 | B1 | 11/2001 | Oommen et al. | |
| 6,398,986 | B1 * | 6/2002 | McShane et al. | 252/579 |

FOREIGN PATENT DOCUMENTS

| | | | |
|---|---|---|---|
| JP | 60-9006 | A | 1/1985 |
| JP | 61-260503 | A | 11/1986 |
| JP | 9-259638 | A | 10/1997 |
| JP | 11-306864 | A | 11/1999 |
| JP | 2000-90740 | A | 3/2000 |
| JP | 2004-273291 | A | 9/2004 |
| WO | WO-97/22977 | A1 | 6/1997 |
| WO | WO-98/31021 | A1 | 7/1998 |
| WO | WO-00/11682 | A1 | 3/2000 |
| WO | WO-2005/022558 | A1 | 3/2005 |

OTHER PUBLICATIONS

Lindren, Environmentally Acceptable Transformer Fluids, Nov. 2000, EPRI, Powertech Labs, Inc., (98 pages).*

Oommen, T.V., Vegetable oils for liquied-filled transformers, 2002, IEEE Electrical Insulatin Magazine, vol. 18, No. 1, pp. 6-11 (6 pages).*

Hui, Y.H. ed., Chemstry, Composition and Structrue, 1996, Bailey's Industrial Oil and Fat Products, Wiley-Interscience, 5th Edition, vol. 1, pp. 397-399 (5 pages).*

* cited by examiner

*Primary Examiner* — Yate K Cutliff
(74) *Attorney, Agent, or Firm* — Birch, Stewart, Kolasch & Birch, LLP

(57) ABSTRACT

Disclosed is a base agent for electrical insulating oils, which mainly contains an esterified product of glycerin and a linear or branched, saturated or unsaturated fatty acid having 6-14, preferably 8-12 carbon atoms. This base agent for electrical insulating oils is excellent in electrical characteristics, oxidation stability, cooling characteristics, flame retardance and safety. In particular, this agent for electrical insulating oils can meet energy/environmental problems by using an edible oil and fat, which is obtained by using a fatty acid derived from a vegetable oil as a raw material, as the linear or branched, saturated or unsaturated fatty acid having 6-14 carbon atoms.

19 Claims, No Drawings

BASE AGENT FOR ELECTRICAL INSULATING OIL

TECHNICAL FIELD

This invention relates to a base agent for electrical insulating oils and more particularly, to a base agent for electrical insulating oils, which is excellent in electric characteristics, cooling characteristic and flame retardance.

BACKGROUND ART

For electrical insulating oils used for purposes of insulation, cooling and the like of transformers, cables, breakers, capacitors and the like, there have been long used mineral insulating oils that are obtained by subjecting a heavy crude oil to vacuum distillation for separation into given fractions and refining by treatment with sulfuric acid, an alkali, water washing, white clay or the like, and synthetic compound-based insulating oils such as diphenyls, silicones, phthalic acid esters and the like.

However, mineral insulating oils not only have the problem on safety and the like because of their high inflammability, but also have the possibility that they becomes difficult in future use from the standpoint of energy and environmental problems.

On the other hand, synthetic compound-based insulating oils also have problems such as of high inflammability, expensiveness and the like. Especially, with phthalic acid esters, it has been pointed out that they are suspected of having the endocrine disrupting action.

It will be noted that although PCB has been once in use, they have serious problems on safety, toxicity, environmental pollution and the like and thus, its use for electric equipments has been prohibited.

To cope with this situation, it has been expected to put natural vegetable oils having excellent safety such as soybean oil, rape seed oil, castor oil and the like to practical use as an electrical insulating oil. However, where a vegetable oil is applied to apparatus of the type where the inside is cooled by convection of an electrical insulating oil such as, for example, a large-sized transformer, the vegetable oil is disadvantageous in that it is high in viscosity and pour point and poor in stability against oxygen and heat (Patent Document 1). Hence, where these vegetable oils are used as an electrical insulating oil, is usual practice is to mix with mineral or synthetic compound-based insulating oils.

However, the mixing with a mineral or synthetic compound-based insulating oil does no lead to a fundamental solution to the above problem.

In recent years, the use, as an electrical insulating oil, of lower alcohol esterified products of vegetable oils such as rape seed oil, corn oil, safflower oil and the like have been proposed (Patent Documents 2 to 4).

In this connection, however, the specific permittivities of these insulating oils are smaller than those of insulating papers employed in electric apparatus and are not in conformity with the insulating paper with respect to the specific permittivity, for which an electric field stress is concentrated on the oil, thus making it difficult to downsize an apparatus in view of the problem on insulation. Additionally, these insulating oils are high inflammability and still have the problem of unsatisfactory stability to oxygen or heat.

Accordingly, the performance of these insulating oils is unsatisfactory for use as an electrical insulating oil capable of solving a future energy problem.

In view of the above, there have been proposed esterified compounds between trimethylolpropane/pentaerythritol and fatty acids having 7 to 18 carbon atoms for use as an insulating oil that is low in inflammability and pour point and excellent in biodegradability (Patent Document 5). However, this compound has problems of high viscosity and a poor cooling characteristic.

The present applicant has already proposed, as an electrical insulating oil excellent in viscosity, fluidity, chemical stability and the like, esterified products of higher fatty acids having 8 to 20 carbon atoms and branched fatty, monovalent alcohols having 6 to 14 carbon atoms, and esterified products of palm oil-derived mixed fatty acids and/or soybean oil-derived mixed fatty acids and aliphatic monovalent alcohols having 1 to 5 carbon atoms or branched aliphatic, monovalent alcohols having 6 to 14 carbon atoms (Patent Document 6).

Although this type of electrical insulating oil is excellent in viscosity, fluidity, chemical stability and the like, the flash point is relatively low and there is some room for improvement in safety.

As stated hereinabove, there has never been known any electrical insulating oil that is well balanced in characteristics such as low inflammability and safety, low viscosity and an excellent cooling characteristic, good stability to oxygen and heat, a high specific permittivity, capability of miniaturizing a transformer, and safety to the human body and environment, and can be used in practice without a problem. Thus, further improvements and developments have been demanded.

Patent Document 1:
JP-A 61-260503
Patent Document 2:
JP-A 9-259638
Patent Document 3:
JP-A 11-306864
Patent Document 4:
JP-A 2000-90740
Patent Document 5:
JP-A 2004-273291
Patent Document 6:
PCT Patent Publication No. WO 2005/022558

DISCLOSURE OF THE INVENTION

Problem to be Solved by the Invention

The invention has been made under these circumstance and has for its object the provision of a base agent for electrical insulating oils, which is excellent in electric characteristic, oxidation stability, cooling characteristic, flame retardance and safety.

Means for Solving the Problems

We have made intensive studies to solve the above problems and, as a result, found that a base agent for electrical insulating oils mainly made of an esterified product of a linear or branched, saturated or unsaturated fatty acid having 6 to 14 carbon atoms and glycerine is excellent in electric characteristic, oxidation stability, cooling characteristic and flame retardance wherein when using, as the linear or branched, saturated or unsaturated fatty acid having 6 to 14 carbon atoms, an edible oil and fat obtained from a vegetable oil-derived fatty acid as a starting material, the resulting electrical insulating oil is able to cope with energy and environmental problems and is excellent in safety, thus arriving at completion of the invention.

More particularly, the invention provides:

1. A base agent for electrical insulating oils, characterized by including, as a main component, an esterified product between a linear or branched, saturated or unsaturated fatty acid having 6 to 14 carbon atoms and glycerine;
2. The base agent for electrical insulating oils as recited in 1, wherein the esterified product is an esterified product of a linear or branched, saturated or unsaturated fatty acid having 8 to 12 carbon atoms and glycerine;
3. The base agent for electrical insulating oils as recited in 1 or 2, wherein the esterified product has a kinetic viscosity of not greater than 20 $mm^2/s$ at 40° C. and a flash point of not lower than 200° C.;
4. The base agent for electrical insulating oils as recited in any one of 1 to 3, wherein the esterified product has a specific permittivity of not lower than 3.0 at 80° C.;
5. The base agent for electrical insulating oils as recited in any one of 1 to 4, wherein the esterified product is contained in amounts not smaller than 60 wt %;
6. The base agent for electrical insulating oils as recited in any one of 1 to 5, wherein the esterified product is constituted of not smaller than 95 wt % of a fatty acid triglyceride;
7. An electric apparatus using a base agent for electrical insulating oils as recited in any one of 1 to 6; and
8. An electric apparatus as recited in 7, wherein the apparatus is a transformer.

Benefits of the Invention

According to the invention, there can be provided a base agent for electrical insulating oils, which is excellent in electric characteristics, oxidation stability, cooling characteristic and flame retardance.

When using, as a linear or branched, saturated or unsaturated fatty acid having 6 to 14 carbon atoms, an edible oil and fat obtained from a vegetable oil-derived fatty acid as a starting material, there can be provided a base agent for electrical insulating oils, which can be adapted to energy and environmental problems and is thus excellent in safety.

BEST MODE FOR CARRYING OUT THE INVENTION

The base agent for electrical insulating oils according to the invention includes as a main component an esterified product of a linear or branched, saturated or unsaturated fatty acid having 6 to 14 carbon atoms and glycerine.

The base agent for electrical insulating oils used herein means a material that becomes a main component of an electrical insulating oil employed for the purpose of insulating and cooling electric apparatuses such as transformers, cables, breakers, capacitors and the like.

It is required that electric insulating oils have a high dielectric breakdown voltage, a high volume resistivity, a small dielectric loss tangent, a high specific permittivity, a small viscosity, an excellent cooling characteristic, excellent stability to oxygen and heat, good chemical stability, no corrosiveness to metal, a small coefficient of thermal expansion, a small volatile content, a low pour point, a wide temperature range sufficient to permit a liquid state, no impurity content and the like. When taking safety under leakage into consideration, the oils should have a high flash point, good biodegradability, a reduced adverse influence on living bodies and an environment, and the like.

In the invention, specific examples of fatty acids having 6 to 14 carbon atoms include caproic acid, enanthic acid, caprylic acid, peralgonic acid, capric acid, undecanoic acid, lauric acid, tridecanoic acid, myristic acid, 4-isocaproic acid, 2-ethylhexanoic acid, 3,5,5-trimethylhexanoic acid, 4-ethylpentanoic acid, hexenoic acid, octenoic acid, nonenoic acid, caproleic acid, myristoleic acid and the like, which may be used singly or in combination of two or more.

If the carbon atoms of the saturated or unsaturated fatty acid are smaller than 6 in number, the resulting esterified product becomes poor in electric characteristics and low in flash point, thus being lack of safety. On the other hand, when the carbon atoms exceed 14 in number, the resulting esterified product becomes high in viscosity, with the attendant drawback that a cooling characteristic for electrical insulating oils lowers. Accordingly, when taking it into account to lower a viscosity of the resulting esterified product and improve the cooling characteristic for electrical insulating oils, the carbon atoms of the fatty acid are preferably at 6 to 14 in number. Moreover, when taking it into consideration to enhance stability to oxygen and heat in addition to the improvement of the cooling characteristic for electrical insulating oils, the number of carbon atoms of the fatty acid is preferably at 8 to 12.

Specific examples of fatty acids having 8 to 12 carbon atoms include caprylic acid, peralgonic acid, capric acid, undecanoic acid, lauric acid, 4-isocaproic acid, 2-ethylhexanoic acid, 3,5,5-trimethylhexanoic acid, 4-ethylpentanoic acid and the like, which may be used singly or in combination of two or more.

It will be noted that from the standpoint of coping with an energy problem as well as reducing an environmental load, the fatty acid having 6 to 14 carbon atoms used as a base agent for electrical insulating oils should preferably be plant oil-derived ones, such as coconut oil, palm kernel oil, soybean oil, palm oil and the like, which are reproducible resources. More particularly, plant oil-derived caprylic acid, peralgonic acid, capric acid, undecanoic acid and lauric acid are most suited among the fatty acids mentioned above.

Glycerine used as a starting material of the esterified product constituting the base agent for electrical insulating oils according to the invention is one that shows the most excellent performance among alcohols capable of yielding esterified products by reaction with fatty acids. For instance, with a monovalent alcohol, an esterified product obtained by use of the alcohol is low in flash point and poor in safety, and has a drawback that it is so low in specific permittivity that a difficulty is involved in miniaturizing a transformer. Moreover, alcohols having an aromatic group such as a benzyl group, a phenyl group or the like are possibly harmful to human bodies and is thus unsuited from the standpoint of safety. With tetrahydric or more polyhydric alcohols such as erythrltol, pentaerythritol, arabitol, xylitol, sorbitol, sorbitan, mannitol, mannitan, galactitol and the like, the resulting esterified products using these alcohols are so high in viscosity that where they are employed as a base agent for electrical insulating oils of transformers, a cooling characteristic becomes poor. Further, with dihydric to trihydric alcohols such as ethylene glycol, trimethylene glycol, 1,4-butanediol, 1,5-pentanediol, 1,6-hexanediol, 1,7-heptanediol, 1,8-octanediol, 1,9-nonanediol, 1,10-decanediol, 1,12-dodecanediol, 1,16-hexadecanediol, diethylene glycol, triethylene glycol, tetraethylene glycol, dipropylene glycol, polyethylene glycol, polypropylene glycol, trimethylolpropane and the like, the esterified products obtained therefrom may satisfy desired performances with respect to flash point, viscosity and the like. Nevertheless, because of petroleum-derived synthetic alcohols, they are not suited from the standpoint of coping with an energy problem and reducing an environmental load.

More particularly, with glycerine, esterified products obtained therefrom satisfy various characteristics required for electrical insulating oils such as viscosity, flash point, specific permittivity, oxidation stability and the like and are very excellent in respect of coping with an energy problem and reducing an environmental load since glycerine is widely distributed as a constituent component of oils and fats in plant oils serving as a reproducible resource, such as coconut oil, palm kernel oil, soybean oil, palm oil, rape seed oil, corn oil and the like.

Preparation of glycerine is not limited and mention is made of processes including (1) preparation from crude glycerine obtained by purifying and concentrating a waste liquor provided as a side product upon degradation of oils and fats of plant oils and lipids of animals or upon preparation of soap, (2) hydrolysis of chlorohydrin obtained from propylene and chlorine, (3) glycerine fermentation of an enzyme, and the like. From the standpoint of coping with an energy problem and reducing an environmental load, it is preferred to use a technique of obtaining from crude glycerine by purifying and concentrating a waste liquor provided as a side product upon fat splitting of plant oils or preparation of soap from plant oils.

The esterified product contained in the base agent for electrical insulating oils of the invention is not limited so far as it is formed of an esterified product of a linear or branched, saturated or unsaturated fatty acid having 6 to 14 carbon atoms and glycerine. It is preferred to use caproic acid triglyceride, enanthic acid triglyceride, caprylic acid triglyceride, peralgonic acid triglyceride, capric acid triglyceride, undecanoic acid triglyceride, lauric acid triglyceride, tridecanoic acid triglyceride, myristic acid triglyceride, 4-isocaproic acid triglyceride, 2-ethylhexanoic acid triglyceride, 3,5,5-trimethylhexanoic acid triglyceride, 4-ethylpentanoic acid triglyceride, hexenoic acid triglyceride, octenoic acid triglyceride, nonenoic acid triglyceride, caproleic acid triglyceride, myristoleic acid triglyceride, and mixtures of two or more thereof. The use of these products ensures well-balanced characteristics such as electric characteristics, cooling characteristic, oxidation stability, flame retardance and safety when used as a base agent for electrical insulating oils.

Especially, when taking an enhancement of chemical stability to oxygen and heat into consideration, esterified products of double bond-free saturated fatty acids and glycerine are more preferred. Of the esterified products indicated above, there can be favorably used caproic acid triglyceride, enanoic acid triglyceride, caprylic acid triglyceride, peralgonic acid triglyceride, capric acid triglyceride, undecanoic acid triglyceride, lauric acid triglyceride, tridecanoic acid triglyceride, myristic acid triglyceride, 4-isocaproic acid triglyceride, 2-ethylhexanoic acid triglyceride, 3,5,5-trimethylhexanoic acid triglyceride, and 4-ethylpentanoic acid triglyceride.

As stated above, from the standpoint of coping with an energy problem and reducing an environmental load, the use of a reproducible resource is preferred and safety to the human body is desirable, for which it is preferred to use caproic acid triglyceride, enanoic acid triglyceride, caprylic acid triglyceride, peralgonic acid triglyceride, capric acid triglyceride, undecanoic acid triglyceride, lauric acid triglyceride, tridecanoic acid triglyceride and myristic acid triglyceride. For instance, Coconad Series (RK, ML, MT) made by Kao Corporation, Actor Series (M-107R, M-1, M-2, M-3, M-4) made by Riken Vitamin Co., Ltd., and Leo Safe MCT-75, MCT-85, made by Lion Corporation are favorable as edible fat and oil of middle chain fatty acid triglycerides.

The esterified products can be prepared by use of various known esterification processes including, for examples, (1) a process wherein a linear or branched, saturated or unsaturated fatty acid having 6 to 14 carbon atoms and glycerine are reacted and esterified in the presence of an acid, an alkali or an organometal catalyst, (2) a process wherein a linear or branched, saturated or unsaturated fatty acid having 6 to 14 carbon atoms and glycerine are subjected to interesterification reaction in the presence of an acid, alkali or organometal catalyst, (3) a process wherein a plant oil such as palm oil, soybean oil, coconut oil or palm kernel oil is fractionated such as by distillation, and (4) a process wherein plant oils such as palm oil, soybean oil, coconut oil and palm kernel oil and glycerine are initially subjected to interesterification reaction in the presence of an acid, alkali or organometal catalyst, followed by fractionation such as by distillation or the like. In these preparation processes, waste oils, waste acids, waste fatty acid esters of edible plant oils may be re-utilized as a linear or branched, saturated or unsaturated fatty acid having 6 to 14 carbon atoms and also as glycerine.

Although the esterified product serving as a base agent of electrical insulating oils according to the invention may be a partial ester such as a fatty acid monoglyceride or a fatty acid diglyceride wherein part of the three hydroxyl groups of glycerine is left unesterified, it is preferred from the standpoint of improving electric characteristics of an insulating oil to use those containing a fatty acid triglyceride wherein all the hydroxyl groups of glycerine have been esterified. More particularly, in view of improving electric characteristics, the esterified product should be preferably constituted of not smaller than 95 wt %, more preferably not smaller than 98 wt % and further more preferably not smaller than 99 wt %, of a fatty acid triglyceride.

In the practice of the invention, an esterified product is contained as a main component of a base agent for electrical insulating oils. Especially, from the standpoint of satisfying the balance of required qualities such as viscosity, flash point, specific permittivity, oxidation stability and the like, the esterified product should be preferably contained in amounts of not smaller than 60 wt %, more preferably not smaller than 80 wt % and further more preferably not smaller than 90 wt %, in the total of an electrical insulating oil.

It will be noted that the term "main component" means that such a component is contained as exceeding 50 wt % in the base agent for electrical insulating oils.

The base agent for electrical insulating oils of the invention should preferably have a kinetic viscosity of not higher than 20 $mm^2/s$ at 40° C. Where the kinetic viscosity exceeds 20 $mm^2/s$, the flash point increases with improved safety. However, circulation of the resulting insulating oil inside a transformer or the like becomes unsatisfactory and thus, there is concern that cooling becomes incomplete, thereby causing superheating. Especially, when the kinetic viscosity at 40° C. is within 10 to 17 $mm^2/s$, there can be provided a base agent for electrical insulating oils, which has a high flash point and thus safe and is low in viscosity and excellent in cooling characteristic.

The base agent for electrical insulating oils of the invention should preferably have a specific permittivity of not smaller than 3.0 at 80° C. If the specific permittivity is smaller than 3.0 at 80° C., a difference in specific permittivity with an insulating paper used inside a transformer is caused, with concern that a difficulty is involved in making a miniaturized transformer or the like. The specific permittivity that is not smaller than 3.0, preferably not smaller than 3.4, comes close to a specific permittivity of insulating paper and thus, partial discharge is unlikely to occur, with the attendant advantage that miniaturization of a transformer or the like becomes possible. In this connection, if the specific permittivity is too high, there is a tendency that the volume resistivity lowers, for which an upper limit of the specific permittivity at 80° C. is preferably at about 6.0.

The flash point of the base agent for electrical insulating oils of the invention should preferably be at 200° C. or over, more preferably 230° C. or over because a higher flash point results in better safety. If the flash point is lower than 200° C., such an agent falls under the third petroleum group in the fourth category of hazardous materials under the Fire Defense Law of Japan, with concern that upon leakage, the fire breaks out. In particular, edible oils and fats of middle chain fatty acid triglycerides having a flash point of not lower than 230° C. correspond to animal and plant oils of the Fire Defense Law of Japan and are favorable because of their low danger of fire and excellent safety. Moreover, if the flashpoint is not lower than 250° C., safety is so high that such an oil is excluded from hazardous materials under the Fire Defense Law, for which the base agent for electrical insulating oils of the invention should preferably have a flash point of not lower than 250° C. Nevertheless, if a flash point exceeds 300° C. as with rape seed oil, the viscosity becomes high, resulting in poor cooling characteristics such as for transformers. Thus, the upper limit is preferably at 300° C. or below.

In order to ensure good stability to oxygen and heat, the base agent for electrical insulating oils of the invention should preferably have a total acid value of not higher than 0.5 mg of KOH/g, more preferably not higher than 0.3 mg of KOH/g, after deterioration in an oxidation stability test (120° C., 75 hours) described in JIS C2101.

Further, in order to ensure excellent electric characteristics, the base agent for electrical insulating oils of the invention has a dielectric loss tangent (80° C.) of not smaller than 5% and a dielectric breakdown voltage of not lower than 30 KV, preferably not lower than 60 KV when determined according to JIS C2101.

In order to reduce a load on a natural environment, the base agent for electrical insulating oils of the invention should preferably a biodegradability of not smaller than 60% (after 28 days), more preferably not smaller than 80% (after 28 days) ad further more preferably not smaller than 85% (after 28 days).

For instance, it has been reported in IUCLID Dataset (Dataset created by EUROPEAN COMMISSION—European Chemical Bureau) that middle chain fatty acid (capric acid/caprylic acid) triglycerides have a biodegradability of 93% (after 28 days), and are a base agent for electrical insulating oils whose load on a natural environment is small and can thus be favorably used in the invention.

Likewise, from the standpoint of reducing a load influence on a natural environment, the base agent for electrical insulating oils of the invention should preferably have a LC 50 concentration of not smaller than 50 mg/liter (96 hours) when subjected to a fish toxicity test.

For instance, it has been reported in IUCLID Dataset (Dataset created by EUROPEAN COMMISSION—European Chemical Bureau) that middle chain fatty acid (capric acid/caprylic acid) triglycerides have a LC 0 concentration of not smaller than of 53 mg/liter (96 hours) when subjected to a fish toxicity test, and are thus a base agent for electrical insulating oils whose load on a natural environment is very small and can be favorably used in the invention.

In order to recognize the influence on the human body and animals, the base agent for electrical insulating oils of the invention are desirous of acquiring, as data, hazard information such as acute toxicity, mutagenicity and the like. For instance, 2-ethylhexanoic acid triglyceride (Exeparl YGO, made by Kao Corporation) acquires, as data, such hazard information as below:

| | |
|---|---|
| Acute toxicity: | peroral, rat, LD50: >2500 mg/kg |
| Dermal irritation: | human being, 60%, 48-hours closed patch test: average point = 0.05 (judging standard and rating: no reaction recognized = 0, slight degree of erythema = 0.5, appreciable degree of erythema = 1, erythema and edema = 2, vesicles and papules along with erythema and edema = 3) |
| Guinea pig, 100% - 24-hours closed patch test: | average point = 0.2 |
| Guinea pig, 100%, four-cycle continuous application test: | average point = 1.0 (judging standard and rating: no reaction recognized = 0, slight degree of erythema recognized = 1, appreciable degree of erythema recognized = 2, erythema and edema recognized = 3, erythema and edema, and crusta or necrosis recognized = 4) |
| Eye irritation: | rabbit, 100%, OECD 405 method: no irritation (based on the EU classification standards) |
| Mutagenicity: | Ames test (*salmonellae* TA98, TA100): negative |
| Reproductive toxicity: | peroral, rat, 6 to 15 days of pregnancy: NOAEL >1000 mg/kg. |

Thus, this compound is a base agent for electrical insulating oils, which is comprehended as giving only a little influence on the human body and animals and can be conveniently employed in the invention.

Further, hazard information of middle chain fatty acid triglycerides have been reported in IUCLID Dataset (Dataset created by EUROPEAN COMMISSION—European Chemical Bureau) in detail, and thus, they are a base agent for electrical insulating oils, which can be comprehended as giving a small influence on the human body and animals and can be conveniently employed in the invention.

The base agent for electrical insulating oils of the invention should preferably be one that has been subjected to purifications such as by removal and separation of glycerine, removal of inorganic components, neutralization, washing with water, distillation, white clay treatment, degassing treatment and the like so as to improve electric characteristics. Especially, where the esterified product is high in both acid value and moisture content, electric characteristics tend to be worsened, so that it is preferred to carry out an adsorption treatment such as with activated earth/activated alumina for the purpose of reducing, at least, an acid value and a degassing treatment for the purpose of reducing moisture.

The adsorption treatment with activated clay/activated alumina is carried out so as to remove free fatty acids, acid/alkali/organometal catalyst and the like, for example, by a procedure wherein activated clay and/or activated alumina is added to an esterified product to adsorb free fatty acids and the like thereon, followed by removing the activated clay and/or activated alumina by filtration.

More particularly, it is preferred to carry out adsorption treatment in such a way that Kyoward series compound (Kyoward 100, 200, 300, 400, 500, 600, 700, 1000, 2000 and the like, made by Kyowa Chemical Industry Co., Ltd.) or Tomitar AD series compound (Tomitar AD 100, 500, 600, 700 and the like, made by Tomita Pharmaceutical Co., Ltd.), which is an inorganic synthetic adsorbing agent mainly composed of Al, Si and the like, is added in an amount of 0.01 to 5 parts by weight per 100 parts by weight of an esterified product, followed by adsorption treatment at 20° C. to 160° C. for 10 minutes to 10 hours in air or in an atmosphere of an inert gas such as nitrogen, argon or the like, or under reduced conditions. According to the above operation, the acid value of the esterified product can be preferably reduced to not larger than 0.0001 to 0.01 mg KOH/g, more preferably not larger than 0.0001 to 0.005 mg KOH/g, with the result that the electric characteristics of the esterified product can be remarkably increased.

The degassing treatment is performed so as to remove moisture and air from the esterified product and is particularly carried out such that after purging with nitrogen, the product is subjected to distillation under reduced pressure at 20 to 160° C. for 10 minutes to 10 hours at a vacuum of 0.1 kPa to 80 kPa. In this stage, a compound that is able to be azeotropic with water, e.g. toluene, kerosene, isopropyl alcohol, ethanol, pyridine or the like, may be added to the esterified product in an amount of 0.1 to 3 moles relative to the moisture in the product in order to carry out azeotropic distillation. Alternatively, moisture may be removed by use of an apparatus such as a vacuum oil cleaning machine. According to these operations, the moisture in the esterified product can be preferably reduced to 0.1 to 100 ppm, more preferably 0.1 to 50 ppm, with the result that the electric characteristics of the esterified product can be remarkably enhanced.

It is preferred that after the degassing treatment, the esterified product is stored in an atmosphere of nitrogen or in dry air so as not to absorb water again. Alternatively, storage may be made by adding 0.1 to 30 parts by weight of a dehydrating agent such as Molecular Sieve 4A (made by Junsei Chemical Co., Ltd.) or the like per 100 parts by weight of the esterified product. The action of a dehydrating agent such as Molecular Sieve 4A or the like enables a moisture content to be maintained under conditions of 0.1 to 50 ppm over a long time.

Although the esterified product may be used on its own as an electrical insulating oil, it may also be used after formulation of additives such as an antioxidant, a metal inactivating agent, an antistatic fluid, a molecular repair agent, a pour point depressant and the like.

The antioxidants include, for example, monophenol antioxidants such as 2,6-di-t-butyl-p-cresol, butylated hydroxyanisole, 2,6-di-t-butyl-4-ethylphenol, stearyl-β-(3,5-di-t-butyl-4-hydroxyphenyl)propionate and the like, bisphenol antioxidants such as 2,2'-methylenebis(4-methyl-6-t-butylphenol), 2,2'-methylenebis(4-ethyl-6-t-butylphenol), 4,4'-thiobis(3-methyl-6-t-butylphenol), 4,4'-butyridenebis(3-methyl-6-t-butylphenol) and the like, high molecular weight phenols such as tetrakis-[methylene-3-(3',5'-di-t-butyl-4'-hydroxyphenyl)-propionate]methane, tocopherols and the like, sulfur antioxidants such as dilauryl 3,3'-thiodipropionate, dimyristyl 3,3'-thiodipropionate, distearyl 3,3'-thiodipropionate and the like, and phosphorus antioxidants such as triphenyl phosphite, diphenylisodecyl phosphite and the like. Of these, there are preferred monophenol antioxidants, such as 2,6-di-t-butyl-p-cresol, butylated hydroxyanisole, 2,6-di-t-butyl-4-ethylphenol, stearyl-β-(3,5-di-t-butyl-4-hydroxyphenyl)propionate and the like, which are excellent in miscibility with the esterified product and have a high antioxidant effect, and tocopherols that are contained in plant oils and fats and are safe to the human body.

The metal inactivating agent used includes, for example, benzotriazole, benzotriazole derivatives, thiazole and the like. Of these, benzotriazole and benzotriazole derivatives, both acting also as an antistatic fluid, are preferred.

For the molecular repair agent, mention is made, for example, of diphenylcarbodiimide, ditolylcarbodiimide, bis(alkylphenyl)carbodiimides such as bis(isopropylphenyl)carbodiimide, bis(butylphenyl)carbodiimide and the like, epoxy compounds such as phenyl glycidyl ether, phenyl glycidyl ester, alkyl glycidyl ethers and alkyl glycidyl esters, and the like.

Examples of the pour point depressant include alkylmethacrylate polymers and alkyl acrylate polymers, preferably polyalkyl methacrylates or alkylacrylate polymers having a weight average molecular weight of about 5,000 to 500,000 and a linear or branched alkyl group having 1 to 20 carbon atoms. Specific examples include polyheptyl acrylate, polyheptyl methacrylate, polynonyl acrylate, polynonyl methacrylate, polyundecyl acrylate, polyundecyl methacrylate, polytridecyl acrylate, polytridecyl methacrylate, polypentadecyl acrylate, polypentadecyl methacrylate, polyheptadecyl acrylate, polyheptadeyl methacrylate, polymethyl acrylate, polymethyl methacrylate, polypropyl acrylate, polypropyl methacrylate and the like. Especially, Aclube 100 series (132, 133, 136, 137, 138, 146, 160) made by Sanyo Chemical Industries, Ltd., are favorable in view of the pour point depressing action and handling of esterified products.

These antioxidant, metal inactivating agent, antistatic fluid, molecular repair agent and pour point depressant may be added singly or in combination of two or more depending on the quality required for individual products. The amount in the base agent for electrical insulating oils is appropriately at 3 wt % or below for individual additives. It is preferred to add an antioxidant within a range of 0.01 to 1 wt %, a metal inactivating agent and an antistatic fluid, each within a range of 5 to 1000 ppm, a molecular repair agent within a range of 0.01 to 1 wt % and a pour point depressant within a range of 0.01 to 1 wt %, which depend on the required qualities, respectively. In order not to adversely influence electric characteristics, the total amount of additives is preferably at 3 wt % or below.

Aside from the above additives, additives such as an antiwear agent, an extreme pressure agent, a viscosity index improver, a cleaning dispersant and the like may be further added singly or in combination of plural additives. The amount of these additives is not limited but should preferably be at 1 wt % or below in the base agent for electric insulating oils.

In the base agent for electrical insulating oils of the invention, an alkylene oxide adduct of glycerine may be used in place of glycerine serving as a constituent of an esterified product. The use of an esterified product of such a glycerine-alkylene oxide adduct leads to a more improved specific permittivity. It will be noted that in the practice of the invention, the esterified product and an ester derivative of a glycerine-alkylene oxide adduct may be mixed to provide a base agent for electrical insulating oils.

For the alkylene oxide, mention is made of glycerine-alkylene oxide adducts of 1 to 15 moles, preferably 1 to 10 mols of ethylene oxide, propylene oxide and/or a mixture thereof subjected to addition reaction with glycerine.

For the preparation of an alkylene oxide adduct, there is mentioned a process wherein an alkylene oxide is subjected insertion reaction with an esterified product of the invention by use of a catalyst mainly composed of an oxide of a metal such as aluminium, magnesium or the like, or an alkylene oxide adduct of glycerine is subjected to esterification/interexchange reaction with an esterified product.

It is to be noted that since the base agent for electrical insulating oils of the invention is excellent in miscibility, it is possible to use by mixing with other types of electrical insulating oils. Other types of usable electrical insulating oils include, for example, an alkylbenzene, an alkylindene, polybutene, a poly-α-olefin, a phthalic acid ester, a diarylalkane, an alkylnaphthalene, an alkylbiphenyl, a triarylalkane, a terphenyl, an arylnaphthalene, 1,1-diphenylethylene, 1,3-diphenylbutene-1, 1,4-diphenyl-4-methyl-penetene-1, a silicone oil, a mineral oil, a plant oil, a lower alcohol esterified product of a plant oil and the like.

Of these other types of electrical insulating oils, a plant oil or a silicone oil is preferably used when taking into account a measure for coping with an energy problem, reduction of a load on an environment and safety. When taking it into consideration to make a low viscosity, the use of a lower alcohol esterified product of a mineral oil or a plant oil is preferred.

The base agent for electrical insulating oils of the invention and other type of electrical insulating oil may be mixed at an arbitrary mixing ratio because of the excellent miscibility of the base agent (esterified product) for electrical insulating oils of the invention. When taking reduction such as of an environmental load into consideration, it is preferred to use not larger than 100 parts by weight of other type of electrical insulating oil per 100 parts by weight of the base oil for electrical insulating oils of the invention.

EXAMPLES

Examples and Comparative Examples are described to more particularly illustrate the invention, which should not be construed as limited to the following Examples.

It will be noted that in the following Examples and Comparative Examples, an acid value, moisture content, kinetic viscosity, flash point, oxidation stability, dielectric breakdown voltage, specific permittivity, and a content of fatty acid triglyceride are, respectively, values measured according to the following methods.

(1) Acid value: determined by a method pursuant to a potentiometric method of JIS K1557.
(2) Moisture content: determined by a method pursuant to the Carl Fisher method of JIS K0068.
(3) Kinetic viscosity: determined by a method pursuant to the Canon Fenske viscometer of JIS K2283.
(4) Flash point: determined by a method pursuant to the Cleaveland open-cup method of JIS K2265.
(5) Oxidation stability: determined by a method pursuant to the electrical insulating oil testing method of JIS C2101.
(6) Dielectric breakdown voltage: determined by a method pursuant to the electric insulating oil testing method of JIS C2101.
(7) Specific permittivity: determined by a method pursuant to the electric insulating oil testing method of JIS C2101.
(8) Content of fatty acid triglyceride: about 40 mg of a sample was placed in a 3-ml vial container, to which 0.5 ml of pyridine, 0.4 ml of hexamethyldisilazane and 0.2 ml of trimethylchlorosilane were added, followed by trimethylsilylation at 80° C. for 30 minutes and subjecting the resulting supernatant liquid to gas chromatographic analysis.

| <Gas chromatographic conditions> | |
|---|---|
| Gas chromatographic apparatus: | GC-9A, made by Shimadzu Corporation |
| Column: | 2% OV-1/Chromosorb W · AW-DMCS (60/80 meshe) 3 mmID × 0.5 ml, made by Shimadzu Corporation |
| Column temperature: | 120° C. → 330° C. (accelerated temperature; 10° C./minute) |
| Detector: | FID |
| Charge port, detector temperatures: | 330° C. |

-continued

| <Gas chromatographic conditions> | |
|---|---|
| Carrier gas: | $N_2$ gas, 50 ml/minute |
| Charge amount: | 1 μl |

Example 1

Coconut and palm kernel oil-derived mixed fatty acid methyl esters (methyl caprylate (Pastel M-8, made by Lion Corporation)/methyl caprate (Pastel M-10, made by Lion Corporation)/methyl laurate (M-12, made by Lion Corporation)/methyl myristate (Pastel M-14, made by Lion Corporation)=51/42/5/2, ratio by weight) and glycerine were charged into a four-necked flask equipped with an stirrer, a thermometer and a partial and complete condenser at a molar ratio between the mixed fatty acid methyl esters and glycerine of 4.0. Then, 0.25 wt % (relative to the mixed fatty acid methyl esters+glycerine) of potassium hydroxide (made by Junsei Chemical Co., Ltd.)/zinc oxide (made by Junsei Chemical Co., Ltd.) was added as a catalyst for carrying out an ester exchange at 180 to 200° C. for 10 hours, followed by reduced-pressure distillation and washing with water to remove unreacted mixed fatty acid methyl esters, glycerine, and monoglyceride and diglyceride side products to obtain not smaller than 95 wt % of mixed fatty acid triglycerides. Next, 1 wt %/2.5 wt % of Kyoward 700 SL/Kyoward 500SH (both made by Kyowa Chemical Industry Co., Ltd.) relative to the thus obtained mixed fatty acid triglycerides were added, followed by adsorption, degassing and dehydrating treatments under a reduced pressure or vacuum of 2.7 kPa at 110° C. for 2 hours, followed by filtration to remove the Kyoward 700 SL/Kyoward 500SH therefrom. A base agent A for electrical insulating oils made of the resulting mixed fatty acid triglycerides had an initial acid value of 0.004 mg KOH/g and a moisture content of 90 ppm.

Example 2

2.5 parts by weight of Kyoward 500SH (made by Kyowa Chemical Industry Co., Ltd.) was added to 100 parts by weight of caprylic acid triglyceride (Coconad RK, made by Kao Corporation) wherein a content of the fatty acid triglyceride that is an edible oil and fat was at not smaller than 97 wt %, followed by adsorption, degassing and dehydrating treatments under a reduced pressure or vacuum of 2.7 kPa at 110° C. for 2 hours. Thereafter, the Kyoward 500SH was removed by filtration. The resulting base agent B for electrical insulating oils had an acid value of 0.002 mg KOH/g and a moisture content of 50 ppm. Molecular Sieve 4A (made by Jusei Chemical Industry Co., Ltd.) was placed in the base agent B for electrically insulating oils so as not to allow moisture to be absorbed therein, followed by storage in an atmosphere of nitrogen, with the result that the moisture content became 10 ppm and this condition could be maintained over 1 month.

Example 3

The adsorption, degassing and dehydrating treatments were carried out in the same manner as in Example 2 with respect to 100 parts by weight of mixed fatty acids (caprylic acid/capric acid=75/25) triglycerides (Leo Safe MCT-75, made by Lion Corporation) wherein a content of the fatty acid triglycerides that are edible oils and fats was at not smaller than 95 wt %. The resulting base agent C for electrical insulating oils had an acid value of 0.005 mg KOH/g and a moisture content of 80 ppm.

Example 4

The adsorption, degassing and dehydrating treatments were carried out in the same manner as in Example 2 with respect to 100 parts by weight of mixed fatty acids (caprylic acid/capric acid=85/15) triglycerides (Leo Safe MCT-85, made by Lion Corporation) wherein a content of the fatty acid triglycerides that are edible oils and fats was at not smaller than 95 wt %. The resulting base agent D for electrical insulating oils had an acid value of 0.003 mg KOH/g and a moisture content of 80 ppm.

Example 5

The adsorption, degassing and dehydrating treatments were carried out in the same manner as in Example 2 with respect to 100 parts by weight of 2-ethylhexanoic acid triglyceride (Exeparl TGO, made by Kao Corporation) wherein a content of the fatty acid triglyceride that is a cosmetic base agent was at not smaller than 97 wt %. The resulting base agent E for electrical insulating oils had an acid value of 0.008 mg KOH/g and a moisture content of 60 ppm.

Example 6

To provide a homogeneous solution, 80 parts by weight of the base agent C for electrical insulating oils obtained in Example 3 and 20 parts by weight of a rape seed oil (made by Junsei Chemical Co., Ltd.) were mixed and stirred. In the same manner as in Example 2, 100 parts by weight of this uniform solution was subjected to adsorption, degassing and dehydrating treatments. The resulting base agent F for electrical insulating oils had an acid value of 0.005 mg KOH/g and a moisture content of 90 ppm.

Example 7

To provide a homogeneous solution, 80 parts by weight of the base agent C for electrical insulating oils obtained in Example 3 and 20 parts by weight of palm oil-derived mixed fatty acid isotridecyl esters (preparation process described in Patent Document 6) were mixed and stirred. In the same manner as in Example 2, 100 parts by weight of this uniform solution was subjected to adsorption, degassing and dehydrating treatments. The resulting base agent G for electrical insulating oils had an acid value of 0.004 mg KOH/g and a moisture content of 40 ppm.

Example 8

To provide a homogeneous solution, 95 parts by weight of the base agent C for electrical insulating oils obtained in Example 3 and 5 parts by weight of 2-ethylhexanoic acid diester of polyethylene glycol (Lionon DEH-40, Lion Corporation) were mixed and stirred. In the same manner as in Example 2, 100 parts by weight of this uniform solution was subjected to adsorption, degassing and dehydrating treatments. The resulting base agent H for electrical insulating oils had an acid value of 0.006 mg KOH/g and a moisture content of 70 ppm.

Example 9

To provide a homogeneous solution, 60 parts by weight of the base agent B for electrical insulating oils obtained in Example 2 and 40 parts by weight of trimethylolpropane tricaprylate (Rubinol F-310N, made by Lion Corporation) were mixed and stirred. In the same manner as in Example 2, 100 parts by weight of this uniform solution was subjected to adsorption, degassing and dehydrating treatments. The resulting base agent I for electrical insulating oils had an acid value of 0.007 mg KOH/g and a moisture content of 80 ppm.

Comparative Examples 1 to 5

A rape seed oil (Comparative Example 1, made by Junsei Chemical Co., Ltd.), a isobutyl ester of rape seed oil (Comparative Example 2, preparation process described in Patent Document 4), 2-ethylhexyl laurate (Comparative Example 3, preparation process described in Patent Document 6), pentaerythritol ester of 3,5,5-trimethylhexanoic acid (Comparative Example 4, preparation process described in Patent Document 5), and a mineral oil (Comparative Example 5, made by Nippon Oil Corporation) were, respectively, used as a base agent for electrical insulating oils.

The base agents A to I for electrical insulating oils obtained in the above examples and also those of Comparative Examples 1 to 5 are summarized in Table 1 with respect to the constituent fatty acids and constituent alcohols and the results of physical property tests.

TABLE 1

| | Base agent for electrical insulating oils | Parts by weight | Fatty acid composition (wt %) | Alcohol | Kinetic viscosity (40° C.), ($mm^2/s$) | Flash point (° C.) | Specific permittivity (80° C.) | Di-electric breakdown voltage (KV/2.5 mm) | Oxidation stability test (mgKOH/g) Initial value | 120° C. after 75 hours |
|---|---|---|---|---|---|---|---|---|---|---|
| Example | 1 A | 100 | Caprylic acid: 51<br>Capric acid: 42<br>Lauric acid: 5<br>Myristic acid: 2 | Glycerine | 14 | 270 | 3.5 | 74 | 0.004 | 0.2 |
| | 2 B | 100 | Caprylic acid: 100 | Glycerine | 12.5 | 235 | 3.8 | 71 | 0.002 | 0.4 |
| | 3 C | 100 | Caprylic acid: 75<br>Capric acid: 25 | Glycerine | 13 | 260 | 3.6 | 72 | 0.005 | 0.3 |
| | 4 D | 100 | Caprylic acid: 85<br>Capric acid: 15 | Glycerine | 12.5 | 255 | 3.7 | 72 | 0.003 | 0.3 |
| | 5 E | 100 | 2-ethylhexanoic acid: 100 | Glycerine | 16 | 220 | 3.5 | 73 | 0.008 | 0.2 |
| | 6 F | C: 80 | Caprylic acid: 75<br>Capric acid: 25 | Glycerine | 17 | 290 | 3.3 | 75 | 0.005 | 0.5 |
| | | Rape | Palmitic acid: | Glycerine | | | | | | |

TABLE 1-continued

| | Base agent for electrical insulating oils | Parts by weight | Fatty acid composition (wt %) | Alcohol | Kinetic viscosity (40° C.), ($mm^2/s$) | Flash point (° C.) | Specific permittivity (80° C.) | Di-electric breakdown voltage (KV/2.5 mm) | Oxidation stability test (mgKOH/g) Initial value | 120° C. after 75 hours |
|---|---|---|---|---|---|---|---|---|---|---|
| | | seed oil: 20 | several % Stearic acid: several % Oleic acid: 58 Linolic acid: 22 Linolenic acid: 11 | | | | | | | |
| | 7 G | C: 80 | Caprylic acid: 75 Capric acid: 25 | Glycerine | 14 | 250 | 3.2 | 72 | 0.004 | 0.3 |
| | | 20 | Palmitic acid: 0.2 Stearic acid: 9 Oleic acid: 72 Linolic acid: 18 | Iso-tridecyl alcohol | | | | | | |
| | 8 H | C: 95 | Caprylic acid: 75 Capric acid: 25 | Glycerine | 16 | 255 | 4.2 | 62 | 0.006 | 0.4 |
| | | 5 | 2-ethylhexanoic acid: 100 | Poly-ethylene glycol Mw = 400 | | | | | | |
| | 9 I | B: 60 | Caprylic acid: 100 | Glycerine | 15 | 260 | 4.0 | 70 | 0.007 | 0.4 |
| | | 40 | Caprylic acid: 100 | Tri-methylol propane | | | | | | |
| Comparative Example | 1 Rape seed oil | 100 | Palmitic acid: several % Stearic acid: several % Oleic acid: 58 Linolic acid: 22 Linolenic acid: 11 | Glycerine | 36 | 330 | 2.8 | 77 | 0.04 | 1.2 |
| | 2 Isobutyl ester of rape seed oil | 100 | Palmitic acid: several % Stearic acid: several % Oleic acid: 58 Linolic acid: 22 Linolenic acid: 11 | Isobutyl alcohol | 6 | 210 | 2.9 | 80 | 0.005 | 1.1 |
| | 3 2-ethyl hexyl laurate | 100 | Lauric acid: 100 | 2-ethyl hexanol | 5 | 175 | 2.7 | 78 | 0.002 | 0.3 |
| | 4 Penta erythritol 3,3,5-trimethyl hexanoate | 100 | 3,3,5-trimethyl-hexanoic acid: 100 | Penta-erythritol | 110 | >250 | >3.0 | 55 | 0.02 | 0.8 |
| | 5 Mineral oil | 100 | — | — | 8.5 | 160 | 2.2 | 75 | <0.01 | 0.2 |

As shown in Table 1, it will be seen that the base agents A to I for electrical insulating oils of Examples 1 to 9 exhibit better-balanced and more excellent values than the base agents for electrical insulating oils of Comparative Examples 1 to 5 with respect to all of the viscosity indicating a cooling characteristics, the flash point indicating safety, the specific permittivity which is an index ensuring the possibility of miniaturization such as of transformers, a dielectric breakdown voltage which is a fundamental performance for use as a base agent for electrical insulating oils, and oxidation stability as a base agent for electrical insulating oils. Especially, the base agents of the examples having a flash point of not lower than 250° C. are excluded from the category of hazardous materials under the Fire Defense Law of Japan and are thus high in safety.

Since the middle chain fatty acid triglycerides obtained in Examples 1 to 4 are edible oils and fats derived from plant oils, evidence is given to the safety to the human body along with a very small load on an environment. The fatty acid triglyceride obtained in Example 5 is a base agent for cosmetics and thus, its safety is evidenced.

Example 10

To provide a homogeneous solution, 0.1 wt % of 2,6-di-t-butyl-p-cresol was added to and dissolved in the base agent A for electrical insulating oils obtained in Example 1. The resulting base agent A' for electrical insulating oils (initial acid value: 0.004 mg KOH/g) was subjected to an oxidation stability test (120° C., 75 hours), revealing that the acid value was at 0.05 mg KOH/g. The results are shown in Table 2.

Examples 11 to 13

To provide a homogeneous solutions, 0.1 wt % of 2,6-di-t-butyl-p-cresol was, respectively, added to and dissolved in the base agents E, F and G for electrical insulating oils in the same manner as in Example 10. The resulting base agents E', F' and G' for electrical insulating oils were, respectively, subjected to an oxidation stability test (120° C., 75 hours), with the results shown in Table 2.

Comparative Examples 6, 7

To provide a homogeneous solutions, 0.1 wt % of 2,6-di-t-butyl-p-cresol was, respectively, added to and dissolved in the rape seed oil of Comparative Example 1 and the isobutyl ester of rape seed oil of Comparative Example 2 in the same manner as in Example 10. The resulting base agents for electrical insulating oils were, respectively, subjected to an oxidation stability test (120° C., 75 hours), with the results shown in Table 2.

TABLE 2

| | Base agent for electrical insulating oils | Oxidation stability test (mgKOH/g) Initial value | 120° C. after 75 hours |
|---|---|---|---|
| Example 10 | A' | 0.004 | 0.05 |
| Example 11 | E' | 0.008 | 0.02 |
| Example 12 | F' | 0.005 | 0.1 |
| Example 13 | G' | 0.004 | 0.02 |
| Comparative Example 6 | Rape seed oil composition | 0.04 | 0.7 |
| Comparative Example 7 | Rape seed oil isobutyl ester composition | 0.005 | 0.7 |

As shown in table 2, the compositions A', E', F' and G' of Examples 10 to 13 are remarkably improved over those of Comparative Examples 6, 7 by the addition of 2, 6-di-t-butyl-p-cresol with respect to the oxidation stability, revealing that they are high in stability to oxygen and heat.

Example 14, Comparative Example 8

Where an electrical insulating oil is used to provide a transformer, the volumetric dimension, weight and the like of the transformer is influenced by the magnitudes of specific heat, thermal conductivity and kinetic viscosity of the electrical insulating oil. Among them, the effect of the kinetic viscosity is great, and a smaller value becomes more advantageous from the standpoint of a cooling design, thus being good for weight saving and compactness.

The kinetic viscosities of the base agents A to I for electrical insulating oils of Examples 1 to 9 according to the invention range 12.5 to 17 ($mm^2/s$) and are thus smaller than a kinetic viscosity of 36 ($mm^2/s$) of the rape seed oil of Comparative Example 1.

Using the base agent A (kinetic viscosity: 14 ($mm^2/s$)) for electrical insulating oils of Example 1 of the invention (Example 14) and the rape seed oil of Comparative Example 1 (Comparative Example 8), trial designs were made with respect to transformers of 66/11kV30MVA specification to compare specification data with each other. The results are shown in Table 3. It will be noted that in the trial designs, the comparison was made while taking into account the specific heat, thermal conductivity, density and coefficient of volume expansion of the respective electrical insulating oils.

TABLE 3

| | 66/11 kV 30 MVA Transformer | | Reduction Rate of |
|---|---|---|---|
| | Comparative Example 8 (rape seed oil) | Example 14 (base agent A for electrical insulating oils) | weight saving and compactness relative to Comparative Example 8 (%) |
| Volume (%) | 100 | 74 | 26 |
| Weight (%) | 100 | 90 | 10 |
| Cooler (%) | 100 | 59 | 41 |

From the results of Table 3, the transformer (Example 14) using base agent A for electrical insulating oil is reduced in weight over and becomes more compact by 26% in volume, and 10% in weight than the transformer (Comparative Example 8) using the rape seed oil of Comparative Example 1. The cooler becomes compact in size by 41%.

The invention claimed is:

1. An electrical insulating oil, comprising:

a base agent comprising as a main component a glyceride being an esterified product between a linear or branched, saturated fatty acid having 8 to 12 carbon atoms and glycerine, wherein said glyceride is contained in an amount of not less than 80 wt % based on the total weight of the electrical insulating oil.

2. A base agent for electrical insulating oils, characterized by comprising as a main component a middle chain fatty acid triglyceride being an esterified product between a middle chain fatty acid and glycerine.

3. The electrical insulating oil according to claim 1, wherein said glyceride has a kinetic viscosity of not higher than 20 $mm^2/s$ at 40° C. and a flash point of not lower than 200° C.

4. The electrical insulating oil according to claim 1, wherein said glyceride has a specific permittivity of not smaller than 3.0 at 80° C.

5. The electrical insulating oil according to claim 1, wherein said glyceride is constituted of not less than 95 wt % of a fatty acid triglyceride.

6. An electric apparatus using the electrical insulating oil defined in claim 1.

7. The electric apparatus according to claim 6, wherein said apparatus is a transformer.

8. The base agent for electrical insulating oils according to claim 2, wherein said middle chain fatty acid consists of caprylic acid only or mixed fatty acids of caprylic acid and capric acid.

9. The base agent for electrical insulating oils according to claim 8, wherein said caprylic acid is contained in an amount of 75 to 100 wt % based on the total weight of said middle chain fatty acid.

10. The base agent for electrical insulating oils according to claim 2, wherein said middle chain fatty acid triglyceride has a kinetic viscosity of not higher than 20 $mm^2/s$ at 40° C. and a flash point of not lower than 200° C.

11. The base agent for electrical insulating oils according to claim 2, wherein said middle chain fatty acid triglyceride has a specific permittivity of not smaller than 3.0 at 80° C.

12. An electric apparatus using the base agent for electrical insulating oils defined in claim 2.

13. The electric apparatus according to claim 12, wherein said apparatus is a transformer.

14. The electrical insulating oil according to claim 1, wherein said glyceride is contained in an amount of not less than 90 wt % based on the total weight of the electrical insulating oil.

15. The electrical insulating oil according to claim 14, further comprising an additive selected from the group consisting of an antioxidant, a metal inactivating agent, an antistatic fluid, a molecular repair agent, a pour point depressant, and mixtures thereof.

16. The electrical insulating oil according to claim 15, wherein the total amount of additives is 3 wt % or below based on the total weight of the base agent.

17. An electrical insulating oil, comprising:

a base agent comprising as a main component a middle chain fatty acid triglyceride being an esterified product between a middle chain fatty acid and glycerine, wherein said middle chain fatty acid triglyceride is contained in an amount of not less than 80 wt % based on the total weight of the electrical insulating oil.

18. The electrical insulating oil according to claim 17, further comprising an additive selected from the group consisting of an antioxidant, a metal inactivating agent, an antistatic fluid, a molecular repair agent, a pour point depressant, and mixtures thereof.

19. The electrical insulating oil according to claim 18, wherein the total amount of additives is 3 wt % or below based on the total weight of the base agent.

* * * * *